US005587268A

United States Patent [19]

Defieuw et al.

[11] Patent Number: 5,587,268

[45] **Date of Patent: *Dec. 24, 1996**

[54] THERMAL TRANSFER IMAGING PROCESS

[75] Inventors: Geert Defieuw, Kessel-Lo; Wilhelmus Janssens, Aarschot; Luc Vanmaele, Lochrist, all of Belgium

[73] Assignee: Agfa-Gevaert N.V., Mortsel, Belgium

[ * ] Notice: The term of this patent shall not extend beyond the expiration date of Pat. No. 5,547,809.

[21] Appl. No.: 400,343

[22] Filed: Mar. 8, 1995

[30] Foreign Application Priority Data

Mar. 25, 1994 [EP] European Pat. Off. ..... 94200796

[51] Int. Cl.[6] ..... G03C 8/00

[52] U.S. Cl. ..... 430/200; 430/203; 430/964

[58] Field of Search ..... 430/200, 203, 430/964

[56] References Cited

U.S. PATENT DOCUMENTS

| | | | |
|---|---|---|---|
| 3,094,417 | 6/1963 | Workman | 430/203 |
| 3,218,166 | 11/1965 | Reitter | 430/203 |
| 3,767,414 | 10/1973 | Huffman et al. | 430/151 |
| 3,795,532 | 3/1974 | Newman et al. | 503/210 |
| 5,026,677 | 6/1991 | Vanmaele | 503/227 |
| 5,310,640 | 5/1994 | Markin et al. | 430/527 |
| 5,372,986 | 12/1994 | Defieuw et al. | 503/227 |
| 5,374,514 | 12/1994 | Kirk et al. | 430/619 |
| 5,380,607 | 1/1995 | Van Haute et al. | 430/200 |
| 5,384,238 | 1/1995 | Ellis et al. | 430/617 |

FOREIGN PATENT DOCUMENTS

| | | |
|---|---|---|
| 0582144 | 11/1994 | European Pat. Off. . |
| 61-259253 | 11/1986 | Japan . |

OTHER PUBLICATIONS

"Photothermographic Materials", Research Disclosure, vol. 177, No. 6, Jan. 1979, Havant GB, p. 26.

"Thermal Dye Transfer", Research Disclosure, vol. 320, No. 19, Dec. 1990, Havant GB, pp. 928–939, Janssens et al.

*Primary Examiner*—Janet C. Baxter

*Attorney, Agent, or Firm*—Brumbaugh, Graves, Donohue & Raymond

[57] ABSTRACT

The present invention provides a donor element comprising on a support a donor layer comprising a binder, a thermotransferable reducing agent capable of reducing a silver source to metallic silver upon heating and a thermotransferable dye. When such a donor element is used in a thermal transfer printing process in conjunction with a receiving element having a receiving layer that contains a thermoreducible silver source, an image of a neutral black tone and having a high optical density is obtained.

4 Claims, No Drawings

THERMAL TRANSFER IMAGING PROCESS

DESCRIPTION

1. Field of the Invention

The present invention relates to a thermal imaging process, more in particular to a method wherein a thermotransferable reducing agent of a donor element is transferred image-wise to a receiving layer comprising a thermoreducible silver source, by means of e.g. a thermal head or a laser.

2. Background of the Invention

Thermal imaging or thermography is a recording process wherein images are generated by the use of image-wise modulated thermal energy.

In thermography two approaches are known:

1. Direct thermal formation of a visible image pattern by imagewise heating of a recording material containing matter that by chemical or physical process changes colour or optical density.
2. Formation of a visible image pattern by transfer of a coloured species from an imagewise heated donor element onto a receptor element.

A survey of "direct thermal" imaging methods is given in the book "Imaging Systems" by Kurt I. Jacobson-Ralph E. Jacobson, The Focal Press—London and New York (1976), Chapter VII under the heading "7.1 Thermography". Thermography is converned with materials which are not photosensitive, but are heat sensitive. Imagewise applied heat is sufficient to bring about a visible change in a thermosensitive imaging material.

According to a direct thermal embodiment operating by physical change, a recording material is used which contains a coloured support or support coated with a coloured layer which itself is overcoated with an opaque white light reflecting layer that can fuse to a clear, transparent state whereby the coloured support is no longer masked. Physical thermographic systems operating with such kind of recording material are described on pages 136 and 137 of the above mentioned book of Kurt I. Jacobson et al.

Yet most of the "direct" thermographic recording materials are of the chemical type. On heating to a certain conversion temperature, an irreversible chemical reaction takes place and a coloured image is produced.

It has been suggested to use a thermoreducible silver source in combination with a reducing agent in a direct thermal film in order to increase the optical density in transmission of a printed image (see e.g. EP-A-537.975). Although continuous tones can be obtained by said printing method, the gradation produced by said printing method is too high. Fluctuations in the heat transfer from the heat source to the printing material result in a density difference of the final image. Thus, it is extremely difficult to obtain images having a uniform density profile. A direct thermal printing method moreover has the disadvantage that in the non-image places the coreactants always remains unchanged, unpariring the shelf-life and preservability.

Thermal dye transfer printing is a recording method wherein a dye-donor element is used that is provided with a dye layer wherefrom dyed portions or incorporated dye is transferred onto a contacting receiving element by the application of heat in a pattern normally controlled by electronic information signals.

In thermosublimation printing, dyes are transferred to a receiving element. It is possible to obtain an image with an excellent grey tone, however, with limited optical densities (2.0–2.5).

It has been suggested to increase the density of a print made by thermal sublimation printing by printing several times on the same receiving sheet.

This procedure is slow and optical densities in transmission above 3.0 are hardly obtained with a good image stability.

In European Patent Application No. 94200612.3, a thermal imaging process is provided using (i) a donor element comprising on a support a donor layer containing a binder and a thermotransferably reducing agent capable of reducing a silver source to metallic silver upon heating and (ii) a receiving element comprising on a support a receiving layer comprising a silver source capable of being reduced by means of heat in the presence of a reducing agent, said thermal imaging process comprising the steps of bringing said donor layer of said reducor donor element into face to face relationship with said receiving layer of said receiving element.

image-wise heating a thus obtained assemblage by means of a thermal head, thereby causing image-wise transfer of an amount of said thermotransferable reducing agent to said receiving element in accordance with the amount of heat supplied by said thermal head, and separating said donor element from said receiving element. This printing method is further referred to as 'reducing agent transfer printing' or 'RTP' and provides images having a high optical density.

In the above thermal transfer printing process, however, it has been found extremely difficult to obtain a high optical density combined with a neutral grey tone necessary e.g. for medical diagnostics.

OBJECT OF THE PRESENT INVENTION

It is an object of the present invention to provide a donor element for use in thermal transfer printing wherein said donor element contains a donor layer comprising a binder and a thermotransferable reducing agent capable of reducing a silver source to metallic silver upon heating and that can yield images of having a high optical density and an improved neutral black or grey tone.

In accordance with the present invention there is provided a donor element comprising on a support (a) a donor layer comprising a binder, a thermotransferable reducing agent capable of reducing a silver source to metallic silver upon heating and a thermotransferable dye, and (b) a heat-resistant layer provided on the side of the support opposite to the side having said donor layer.

The present invention further provides a thermal imaging process using (i) a donor element comprising on a support a donor layer comprising a binder, a thermotransferable reducing agent capable of reducing a silver source to metallic silver upon heating and a thermotransferable dye and (b) a heat-resistant layer provided on the side of the support opposite to the side having said donor layer and (ii) a receiving element comprising on a support a receiving layer comprising a silver source capable of being reduced by means of heat in the presence of a reducing agent, said thermal imaging process comprising the steps of bringing said donor layer of said donor element into face to face relationship with said receiving layer of said receiving element, image-wise heating a thus obtained assemblage preferably by means of a thermal head or a laser, thereby causing image-wise transfer of an amount of said thermotransferable reducing agents to said receiving element in accordance with the amount of heat supplied and separating said donor element from said receiving element.

The present invention further provides a thermal imaging system consisting of a donor element and a receiving element, said donor element being as defined above and said receiving element comprising on a support a receiving layer comprising a silver source capable of being reduced by means of heat in the presence of a reducing agent.

DETAILED DESCRIPTION OF THE INVENTION

The donor element for use according to present invention comprises on one side of the donor element a donor layer, comprising a thermotransferable reducing agent capable of reducing a silver source to metallic silver, a thermotransferable dye and a binder.

The reducing agent for the silver source may comprise any of the conventional photographic developers known in the art, such as phenidone, hydroquinones and catechol provided that the reducing agent is thermotransferable.

Examples of suitable reducing agents are aminohydroxycycloalkenone compounds, esters of amino reductones, N-hydroxyurea derivatives, hydrazones of aldehydes and ketones, phosphoramidophenols, phosphoramidoanilines, polyhydroxybenzenes, e.g. hydroquinone, t-butylhydroquinone, isopropylhydroquinone, and (2,5-dihydroxyphenyl)methylsulfone, dihydroxybenzene derivatives such as pyrocatechol, and pyrogallol derivatives such as 4-phenylpyrocatechol, t-butylcatechol, pyrogallol, or pyrogallol derivatives such as pyrogallol ethers or esters, dihydroxybenzoic acid, dihydroxybenzoic acid esters such as dihydroxybenzoic acid, methyl ester, ethyl ester, propyl ester, butyl ester and the like, gallic acid, gallic acid esters such as methyl gallate, ethyl gallate, propyl gallate and the like, gallic acid amides, sulfhydroxamic acids, sulfonamidoanilines, 2-tetra zolylthiohydroquinones, e.g., 2-methyl-5-(1-phenyl-5-tetrazolylthio)hydroquinone, tetrahydroquinoxalines, e.g. 1,2,3,4,-tetrahydroquinoxaline, amidoximes, azines, hydroxamic acids, 5-pyrazolones, sulfonamidophenol reducing agents, 2-phenylindan-1,3-dione and the like, 1,4-dihydropyridines, such as 2,6-dimethoxy-3,5-dicarbethoxy-1,4-dihydropyridine, bisphenols, e.g., bis(2-hydroxy-3-t-butyl-5-methylphenyl) methane, bis(6-hydroxy-m-toly-)mesitol, 2,2-bis (4-hydroxy-3-methylphenyl)propane, 4,4-ethylidene-bis(2-t-butyl-6-methylphenol) and 2,2-bis(3,5-dimethyl-4-hydroxyphenyl) propane, ascorbic acid derivatives and 3-pyrazolidones.

Reducing agents being coloured in an oxidized form or capable of forming colour in an oxidized form (further referred to as color forming reducing agents) can also be used. Specific examples are 4-methoxynaphthol and leucoazomethines in particular leucoindoanilines such as for example:

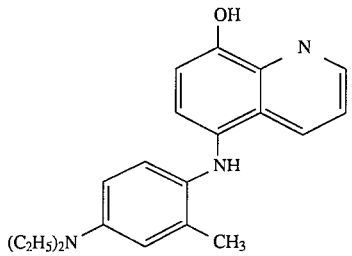

L1

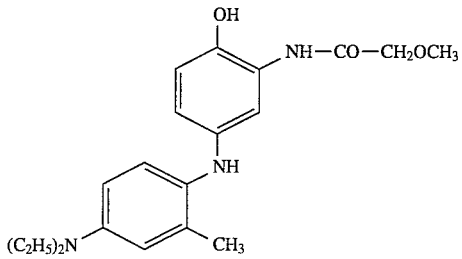

L2

Reducing agents derived from dihydroxy or trihydroxyphenyl compounds are especially preferred. Highly preferred are 4-phenyl pyrocatechol and propyl gallate.

Preferred thermotransferable dyes for use in connection with the present invention are dyes having a hue that is complementary to the hue of the metallic silver image that forms in the image receiving layer of the image receiving element. Particular examples of dyes that can be used in connection with the present invention are azomethine dyes as disclosed in EP 400,704 and U.S. Pat. No. 5,134,115, indoaniline dyes as disclosed in U.S. Pat. No. 4,987,119, U.S. Pat. No. 4,695,287, U.S. Pat. No. 4,829,047 and U.S. Pat. No. 4,983,493, azo dyes as disclosed in EP 344.592, EP 218.397, EP 302.628, EP 352.006 and EP 546.700, anthraquinone dyes as disclosed in U.S. Pat. No. 4,940,692 and EP 209.911, azino dyes as disclosed in EP 93203571, heterocyclic dyes as disclosed in U.S. Pat. No. 5,175,069 or mixtures of these dyes such disclosed in e.g. U.S. Pat. No. 5,177,022, EP 366.261, U.S. Pat. No. 4,933,226, EP 361.197 and JP 05-131765. Particularly preferred in accordance with the present invention are the dyes disclosed in EP 400.706 which are incorporated herein by reference. The latter dyes appear to have the advantage that crystallization of the thermotransferable reducing agent in the donor layer is substantially reduced in the presence of one or more of these dyes.

A non-exhaustive list of dyes that can be used in the present invention are given in the following table 1:

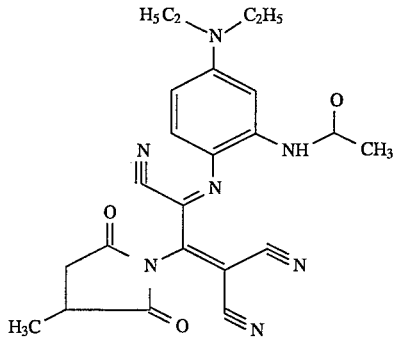

D1

-continued
D2
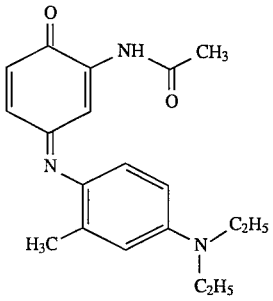
D3
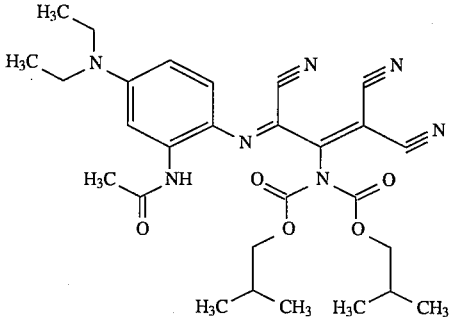
D4
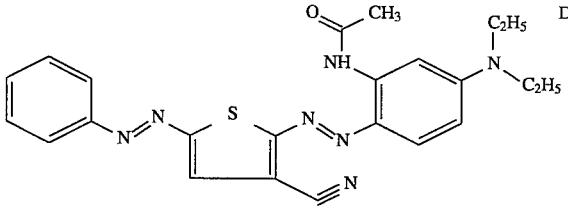
D5
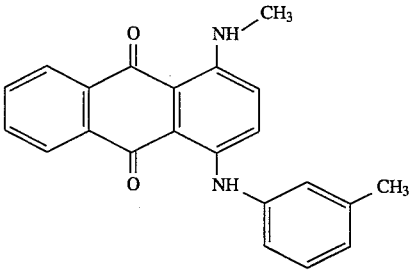
D6
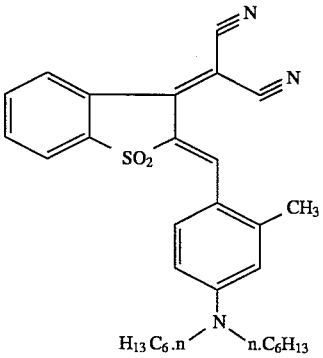
-continued
D7
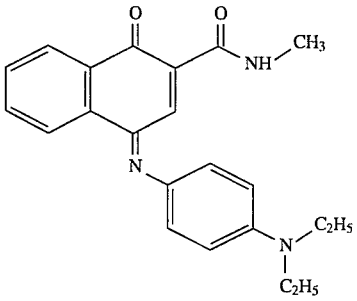
D8
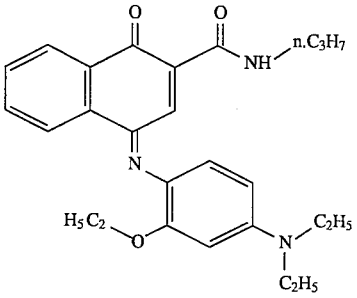
D9
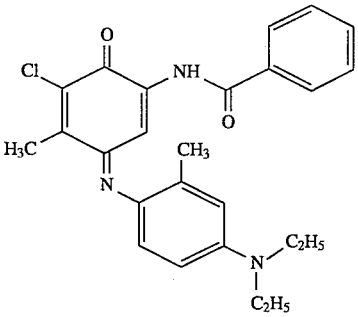
D10
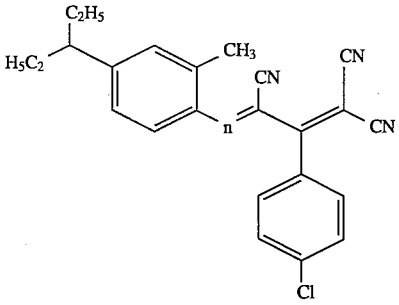
D11
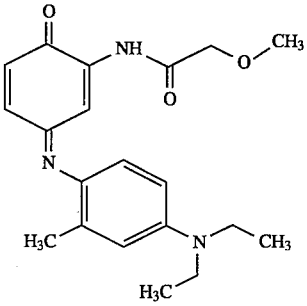

-continued

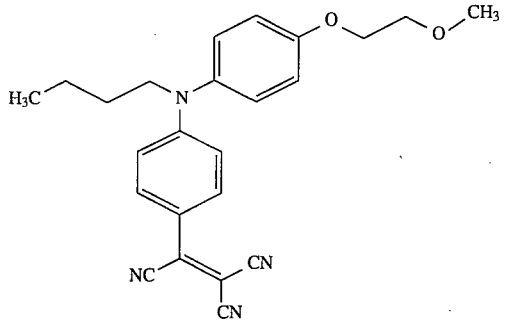

D12

The use of a dye having an absorption maximum in the range above 500 nm is preferred and in particular the use of a cyan or a blue dye is especially preferred, while images obtained with reducing agent transfer printing are usually coloured yellow to brown. The extinction coefficient of the dye at the absorption maximum (measured in the coating solvent) is preferably at least 8000 l/(mol*cm) and more preferably at least 20000 l/(mol*cm).

The amount of dye or dye mixture is preferably lower than the amount of reducing agent or reducing agent mixture in the donor layer.

The addition of a dye can have a positive influence on the stability of the donor element during storage at elevated temperature (40°–60° C.). More particularly, the crystallization of the reducing agent(s) can be avoided as already mentioned above.

As a binder for the donor layer, hydrophilic or hydrophobic binders can be used, although the use of hydrophobic binders is preferred.

Hydrophilic binders which can be used are polyvinylalcohol, gelatine, polyacrylamide and hydrophilic cellulosic binders such as hydroxyethyl cellulose, hydroxypropyl cellulose and the like.

The hydrophobic binders may be used as a dispersion in e.g. water or as a solution in an organic solvent.

Suitable binders for the donor layer are cellulose derivatives, such as ethyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derivated from acrylates and acrylate derivatives, such as polymethyl metahcrylate and styreneacrylate copolymers; polyester resins; polycarbonates; copoly(styrene-co-acrylonitrile); polysulfones; polyphenylene oxide; organosilicones, such as polysiloxans; epoxy resins and natural resins, such as gum arabic. Preferably, the binder for the donor layer in accordance with the present invention comprises poly(styrene-co-acrylonitrile) or a mixture of poly(styrene-co-acrylonitrile) and a toluenesulphonamide condensation product.

The binder for the donor layer preferably comprises a copolymer comprising styrene units and acrylonitrile units, preferentially at least 60% by weight of styrene units and at least 25% by weight of acrylonitrile units binder. The binder copolymer may, of course, comprise other comonomers than styrene units and acrylonitrile units. Suitable other comonomers are e.g. butadiene, butyl acrylate, and methyl methacrylate. The binder copolymer preferably has a glass transition temperature of at least 50° C.

It is also possible to use a mixture of the copolymer comprising styrene units and at least 15% by weight of acrylonitrile units with another binder known in the art, but preferably the acrylonitrile copolymer is present in an amount of at least 50% by weight of the total amount of binder.

The donor layer generally has a thickness of about 0.2 to 5.0 μm, preferably 0.4 to 2.0 μm, and the amount ratio of reducing agent and dye to binder generally ranges from 9:1 to 1:3 by weight, preferably from 3:1 to 1:2 by weight.

The donor layer may also contain other additives such as i.a. thermal solvents, stabilizers, curing agents, preservatives, dispersing agents, antistatic agents, defoaming agents, and viscosity-controlling agents.

The donor layer in accordance with the present invention may consist of multiple layers. In the latter case the thermotransferable dye and thermotransferable reducing agent may be provided in different layers.

Any material can be used as the support for the donor element provided it is dimensionally stable and capable of withstanding the temperatures involved, up to 400° C over a period of up to 20 msec, and is yet thin enough to transmit heat applied on one side through to the reducing agent on The other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. The support preferably has a thickness of 3 to 10 μm in order to allow for a good heat transfer across the support, so that a good transfer of dye(s) and reducing agent(s) is obtained. The support may also be coated with an adhesive of subbing layer, if desired.

Subbing layers comprising aromatic copolyesters, vinylidene chloride copolymers, organic titanate, zirconates and silanes, polyester urethanes and the like can be used.

The donor layer of the donor element can be coated on the support or printed thereon by a printing technique such as a gravure process.

A barrier layer for the reducing agent and the dye comprising a hydrophilic polymer may also be employed between the support and the donor layer of the donor element to enhance the transfer of reducing agent and dye by preventing wrong-way transfer thereof backwards to the support. The barrier layer may contain any hydrophilic material that is useful for the intended purpose. In general, good results can be obtained with gelatin, polyacrylamide, polyisopropyl acrylamide, butyl methacrylate-grafted gelatin, ethyl methacrylategrafted gelatin, ethyl acrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, or a mixture of cellulose monoacetate and polyacrylic acid.

Certain hydrophilic polymers e.g. those described in EP 227,091 also have an adequate adhesion to the support and the donor layer, so that the need for a separate adhesive or subbing layer is avoided. The particular hydrophilic polymers used in a single layer in the donor element thus perform a dual function, hence are referred to as barrier/subbing layers.

Owing to the fact that the thin support softens when heated during the printing operation and then sticks to the thermal printing head, thereby causing malfunction of the printing apparatus and reduction in image quality, the back of the support (the side opposite to that carrying the dye layer) is typically provided with a heat-resistant layer to facilitate passage of the donor element past the thermal printing head. An adhesive layer may be provided between the support and the heat-resistant layer.

Any heat-resistant layer known in the field of thermal sublimation printing or wax printing can be used in the present invention.

The heat-resistant layer generally comprises a lubricant and a binder. In the conventional heat-resistant layers the binder is either a cured binder as described in e.g. EP 153,880, EP 194,106, EP 314,348, EP 329,117, JP 60/151,096, JP 60/229,787, JP 60/229,792, JP 60/229,795, JP 62/48,589, JP 62/212,192, JP 62/259,889, JP 01/5884, JP 01/56,587, and JP 92/128,899 or a polymeric thermoplast as described in e.g. EP 267,469, JP 58/187,396, JP 63/191,678, JP 63/191,679, JP 01/234,292, and JP 02/70,485.

During printing, a smooth transport of the donor ribbon and the receiving element is required in order to obtain a good density uniformity all over the print.

It is preferred to use different types of lubricants to allow continuous transport of the donor ribbon relative to the thermal head.

Well known lubricants are polysiloxanes such as those mentioned in EP 267,469, U.S. Pat. No. 4,738,950, U.S. Pat. No. 4,866,028, U.S. Pat. No. 4,753,920 and U.S. Pat. No. 4,782,041. Especially useful slipping agents are polysiloxane-polyether block or graft polymers.

Other lubricants for the heat-resistant slipping layer of the donor element are phosphoric acid derivatives such as those mentioned in EP 153,880 and EP 194,106, metal salts of long fatty acids (such as mentioned in EP 458,538, EP 458,522, EP 314,348, JP 01/241,491 and JN 01/222,993), wax compounds such as polyolefin waxes such as e.g. polyethylene or polypropylene wax, carnauba wax, bees wax, glycerine monostearate, amid wax such as ethylene bisstearamide and the like.

A heat-resistant layer such as mentioned in European Patent Application no. 93 202 050.6 is especially preferred.

Inorganic particles such as salts derived from silica such as e.g. talc, clay, china clay, mica, chlorite, silica, or carbonates such as calcium carbonate, magnesium carbonate or calcium magnesium carbonate (dolomite) can be further added to the heat-resistant layer.

It is highly preferred to add mixtures of particles to the heat resistant layer having a Mobs hardness below 2.7 and particles having a Mohs hardness above, 2.7 such as mentioned in EP-A93201642.1.

A mixture of talc and dolomite particles is highly preferred.

A particular heat-resistant layer for the present invention comprises as a binder a polycarbonate derived from a bis-(hydroxyphenyl)-cycloalkane, corresponding to general formula (I):

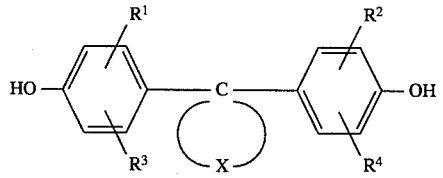

(I)

wherein:

$R^1$, $R^2$, $R^3$, and $R^4$ each independently represents hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, optionally substituted with a $C_1$–$C_6$ alkyl group, a 5- or 6-membered cycloalkyl group or a fused-on 5- or 6-membered cycloalkyl group, as lubricants polyether modified polysiloxane block copolymer and zinc stearate and as particles talc particles with a mean size of 4.5 μm.

Lubricants and binder can be coated in a single layer, or can be casted in a separate layer. It is highly preferred to cast the salt of a fatty acid in the heat resistant layer (e.g. as a dispersion) and the polysiloxane based lubricant in a separate topcoat. This separate topcoat is preferably casted from a non-solvent for the heat-resistant layer.

The heat-resistant layer of the donor element may be coated on the support or printed thereon by a printing technique such as a gravure printing.

The heat-resistant layer thus formed has a thickness of about 0.1 to 3 μm, preferably 0.3 to 1.5 μm.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.a. vinyl chloride, vinylidene chloride, vinyl acetate, acrylonitrile, methacrylate, acrylate, butadiene, and styrene (e.g. poly(vinylidene chloride-co-acrylonitrile). Suitable subbing layers have been described in e.g. EP 138,483, EP 227,090, EP 564010, U.S. Pat. No. 4,567,113, U.S. Pat. No. 4,572,860, U.S. Pat. No. 4,717,711, U.S. Pat. No. 4,559,273, U.S. Pat. No. 4,695,288, U.S. Pat. No. 4,727,057, U.S. Pat. No. 4,737,486, U.S. Pat. No. 4,965,239, U.S. Pat. No. 4,753,921, U.S. Pat. No. 4,895,830, U.S. Pat. No. 4,929,592, U.S. Pat. No. 4,748,150, U.S. Pat. No. 4,965,238, and U.S. Pat. No. 4,965,241.

The receiving element for use according to the printing method of the present invention comprises a receiving layer provided on a support, said receiving layer comprising a silver source capable of being reduced by means of heat in the presence of a reducing agent.

The reducible silver source may comprise any material that contains a reducible source of silver ions. Silver salts of organic and hetero-organic acids, particularly long chain fatty carboxylic acids (comprising from 10 to 30, preferably 15 to 25 carbon atoms) are preferred. Complexes of organic or inorganic silver salts in which the ligand has a gross stability constant for silver ion of between 4.0 and 10.0 are also useful. Examples of suitable silver salts are disclosed in Research Disclosure Nos. 17029 and 29963 and include: salts of organic acids, e.g., gallic acid, oxalic acid, behenic acid, stearic acid, palmitic acid, lauric acid and the like: silver carboxyalkylthiourea salts, e.g., 1-(3-carboxypropyl)thiourea, 1-(3-carboxypropyl)-3,3-dimethylthiourea and the like; complexes of silver with the polymeric reaction product of an aldehyde with a hydroxy-substituted aromatic carboxylic acid, e.g., aldehydes, such as formaldehyde, acetaldehyde and butyraldehyde, and hydroxy-substituted acids, such as salicyclic acid, benzilic acid, 3,5-dihdyroxybenzilic acid and 5,5-thiodisalicylic acid; silver salts or complexes of thiones, e.g., 3-(2-carboxyethyl)-4-hydroxymethyl-4-thiazoline-2-thione and 3-carboxymethyl-4-methyl-4-thiazoline-2-thione; complexes of salts of silver with nitrogen acids selected from imidazole, pyrazole, urazole, 1,2,4-triazole and 1H-tetrazole, 3-amino-5-benzylthio-1,2,4-triazole and benzotriazole; silver salts of saccharin, 5-chlorosalicylaldoxime and the like; and silver salts of mercaptides. The preferred silver source is silver behenate.

The silver source is preferably added as a dispersion to the coating liquid of the receiving layer.

As binding agent for the heat sensitive layer preferably thermoplastic water insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α,β-ethlenically unsatured compounds such as polyvinyl chloride, after chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. A polyvinyl butyral containing some vinyl alcohol units is marketed under the trade name BUTVAR B79 of Monsanto USA.

The binder to organic silver salt weight ratio is preferably in the range of 0.2 to 6, and the thickness of the image forming layer is preferably in the range of 5 to 16 μm.

It is preferred to use a so-called toning agent in the receiving layer or in a layer adjacent to said receiving layer. This toning agent serves to change the tone of the silver image from brown to black or grey. Suitable toning agents are e.g. phthalazinone, phthalazine, phthalimide, succinimide, phthalic acid, benzimidazole or a compound according to formula (II) :

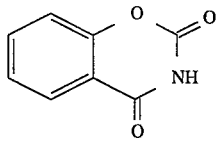

(II)

The use of phthalazinone or compound (II) is highly preferred.

It is highly preferred to use a release agent in the receiving element on the side of the receiving layer. This release agent may be added to the coating solution of the receiving layer or may be applied, optionally in a mixture with other ingredients, as a separate layer called the release layer on top of said receiving layer. The use of a release layer is preferred, since the release agent is in that case on top of the receiving element.

The release agent is preferred in the printing method of the present invention since the reducing agents useful in the present invention can give rise to a sticky contact between donor element and receiving element.

As release agents, inorganic and organic release agents can be used. Among them, the organic release agent, are preferred.

Solid waxes, fluorine- or phosphate-containing surfactants and silicone oils can be used as releasing agent. Suitable releasing agents have been described in e.g. EP 133012, JP 85/19138, and EP 227092.

When, as mentioned above, a separate release layer, incorporating the release agent, is casted on top of said receiving layer, other ingredients such as binders, plasticizers, or particulate fillers such as talc, silica or collodial particles can be added to said release layer, provided that the transfer of the reducing agent to the receiving layer comprising the reducible silver source can take place.

Examples of binders for the release layer are polyvinylbutyral, ethylcellulose, cellulose acetate propionate, cellulose acetate butyrate, polyvinylchloride, copolymers of vinylchloride, vinylacetate and vinylalcohol, aromatic or aliphatic copolyesters, polymethylmethacrylate, polycarbonates derived from bisphenol A, polycarbonates comprising bisphenols according to formule (I) and the like. The release layer can also act as a protective layer for the images.

An adhesive layer is usually provided between the support and the receiving layer, such as those mentioned in e.g. U.S. Pat. No. 4,748,150, U.S. Pat. No. 4,954,241, U.S. Pat. No. 4.965,239 and U.S. Pat. No. 4,965,238 and European Patent Application no. 92 201 620.9.

The subbing layer can further comprise other polymers, particles, or low molecular weight additives. Addition of inorganic particles such as silica, colloidal silica, water soluble polymers such as gelatin, polymeric latices, polystyrene sulfonic acid and polystyrene sulfonic acid sodium salt, surfactants such as cationic, anionic, amphoteric and non-ionic surfactants, and polymeric dispersants is preferred.

Especially preferred additives are colloidal silica, the above mentioned surfactants, butadiene containing latices such as poly(butadiene-co-methylmethacrylate-co-itaconic acid), polystyrene sulfonic acid and polystyrene sulfonic acid sodium salt. The addition of silica to the subbing layer decreases sticking on the coating roll after coating of the subbing layer. The addition of polystyrene sulfonic acid or polystyrene sulfonic acid sodium salt to the subbing layer accelerates the recycling process.

The subbing layer of the present invention is applied directly to the support of the receiving element. The subbing layer can be applied by coextrusion or can be coated on the support. Coating from aqueous solution is preferred due to its simplicity and the possibility of adding other ingredients.

The receiving layer is usually hydrophobic in order to enhance the absorption of reducing agent into the receiving element. The polyester recycling procedure, however, uses a cleaning step whereby the film waste is immersed in an alkaline or acid soap solution in water. It is an object of this cleaning process to remove all layers casted on the polymeric substrate.

In order to remove the hydrophobic receiving layer, it is highly preferred to cast an intermediate layer of an hydrophilic polymer between the subbing layer and the dye-receiving layer. This intermediate layer accelerates the cleaning step in the recycling procedure. Typical examples of hydrophilic polymers which can be used in such intermediate layers are polyvinyl alcohol, polyacrylamide, hydroxyethylcellulose, gelatin, polystyrene sulfonic acid, polyethylene glycol, poly(meth)acrylic acid, poly(meth)acrylic acid, alkali metal salts of polyacrylic acid, crosslinked copolymers containing (meth)acrylic acid or alkali metal salts of (meth)acrylic acid, alkali metal salts of polystyrene sulfonic acid, dextran, carrageenan and the like. Alkali metal salts of polystyrene sulfonic acid such as the sodium salt of polystyrene sulfonic acid is highly preferred, since the use of this polymer in the intermediate layer results in better anti-static properties of the dye-receiving elment. Anti-static coatings such as those described in EP 440,957 can be incorporated in the intermediate layer. This results both in a higher hydrophilicity and in better anti-static properties.

The intermediate layer may further comprise polymeric dispersions or latices, surfactants, inorganic particles such as silica and colloidal silica and the like. Addition of surfactants, colloidal silica and/or latices is preferred. Addition of silica to the intermediate layer decreases sticking to the coating roll after coating. Addition of latices to the intermediate layer improves the addition and improves the removing step in the recycling process in case of acrylic acid or methacrylic acid type latices.

The intermediate layer may also have a cushioning property, such as mentioned in U.S. Pat. No. 4,734,397.

The support for the receiver sheet or element may be a transparant film of e.g. polyethylene terephthalate, a polyether sulfone, a polyimide, a cellulose ester, or a polyvinyl alcohol-co-acetal. The support may also be a reflective one such as barytacoated paper, polyethylene-coated paper, or white polyester i.e. white-pigmented polyester. Blue-coloured polyethylene terephthalate film can also be used as a support.

Although the subbing layer is useful for application on polyethylene-coated paper, substrates based on polyester, transparent or reflective, are preferred. In this case, the subbing layer can be applied before, during or after the biaxial stretching procedure.

At the opposite side of the receiving element (opposite to the receiving layer), a backcoat can be provided, optionally in combination, with an appropriate subbing layer to improve the adhesion between the backcoat and the support.

Hydrophilic as well as hydrophobic backcoats can be used. Hydrophilic backcoats can be applied easily from water, while hydrophobic backcoats have the advantage that the backcoat performs well at all humidity levels (no curl).

Examples of hydrophilic backcoat layers are layers comprising polyvinylalcohol, polyethylene glycol, polyacrylamide, hydroxyethylcellulose, dextran and gelatin. The use of gelatin is highly preferred.

These hydrophilic backcoat layers may further comprise dispersions or latices of hydrophobic polymers, inorganic particles, surfactant and the like. The addition of these particles can be used in order to obtain a specific surface gloss, such as mentioned in EP-A-543441. Especially preferred particles are silica and polymethylmethacrylate beads of 0.5 to 10 μm. Antistatic treatment can also be provided to said backcoat layer.

Examples of hydrophobic backcoat layers are backcoat layers comprising addition polymers such as polymethylmethacrylate, polyvinylchloride and polycondensates such as polyesters, polycarbonates in combination with the above mentioned particles for the hydrophilic backcoat layers.

With hydrophobic backcoat layers, it can be useful to provide an intermediate hydrophilic layer between the subbing layer and the backcoat layer, such as those mentioned for use at the receiving side of the dye-receiving element, in order to improve the removal of the backcoat layer in the recycling procedure.

The printing method of the present invention preferably uses a thermal head to selectively heat specific portions of the donor element in contact with a receiving element. The thermal head can be a thick or thin film thermal head although the use of a thin film thermal head is preferred, since this offers more opportunities to obtain appropriate gradation. The pressure applied to the thermal head is preferably between 120 and 400 g/cm heater line. A spatial resolution of 150 dpi or higher is preferred. The average printing power is calculated as the total amount of energy applied during one line time divided by the line time and by the surface area of the heat-generating elements.

Although a higher average printing power results in higher optical densities of the final image, is is preferred to use an average printing power below 10 W/mm$^2$. At higher printing energies, deformation of the receiving layer and/or receiving sheet occurs.

The time needed for printing one single line with the thermal head, also called the line time, is preferably below 45 ms. Longer line times result in longer printing times and more deformation of the receiving sheet and/or receiving layer.

In order to increase the density of the final image after printing line-by-line with a thermal head, an overall heat treatment of the receiving element may be performed. This heat treatment can be e.g. done with an infrared source, a heated air stream or a hot plate but is preferably done by means of a heated roller.

It is believed that during the overall heat treatment, the transferred reducing agent can further react with the reducible silver source and the dye further migrates into the receiving layer.

By selecting the appropriate diameter and speed of the heated roller, the heat treatment time for the overall heating can be adjusted. Moreover, the heated rollers can be used to uncurl the receiving sheet after printing.

The following examples illustrate the invention in more detail without, however, limiting the scope thereof. All parts are by weight unless otherwise specified.

EXAMPLES

Preparation of the receiving element

A subbed polyethylene terephthalate support having a thickness of 100 μm was coated in order to obtain the following receiving layer:

| | |
|---|---|
| silver behenate | 4.5 g/m$^2$ |
| compound II mentioned above | 0.34 g/m$^2$ |
| polyvinylbutyral (Butvar B79, Monsanto) | 4.5 g/m$^2$ |

After drying, a release layer was coated from hexane comprising 0.03 g/m$^2$ Tegoglide 410 (polyether-polysiloxane blockcopolymer from Goldschmidt). This receiving element was used in the following printing examples.

Preparation of the donor elements

Both sides of a 5.7 μm thick polyethylene terephthalate support were coated with a subbing layer of a copolyester comprising ethylene glycol, adipic acid, neopentyl glycol, terephthalatic acid, isophthalic acid, and glycerol.

The resulting subbing layer was covered with a solution in methyl ethyl ketone of 13% of a polycarbonate having the following structural formula (III):

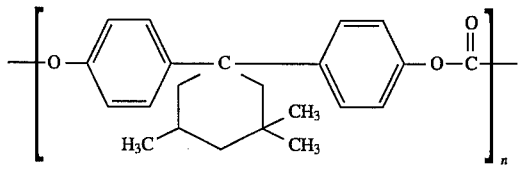

(III)

wherein n represents the number of units to obtain a polycarbonate having a relative viscosity of 1.30 as measured in a 0.5% solution in dichloromethane, 0.5% of talc (Nippon Talc P3, Interorgana) and 0.5% of zinc stearate.

Finally, a top layer of polyether-modified polydimethylsilocane (Tegoglide 410, Goldschmidt) was coated from a solution in isopropanol on the resulting heat-resistant polycarbonate layer.

The other side of the donor element was provided with a donor layer. The nature of the ingredients is mentioned in table 1.

The amount of reducing agent(s) and dye(s) are given in weight % in the coating solution. The binder (10 weight %) was casted together with the reducing agent(s) and the dye(s) from a solution in butanone. These coating solutions were applied at a wet thickness of 10 μm by means of a wire bar. The resulting layer was dried by evaporation of the solvent.

Printing of the combination of donor and receiving elements

Printing was performed by contacting the donor layer of the donor element with the receiving layer of the receiving element, followed by heating by means of a thermal head. The thermal head was a thin film thermal head heated at an average printing power of 5 Watt/mm$^2$ and a line time of 18 ms with a resolution of 300 dpi. The pressure applied between the thermal head and the rotating drum carrying the receiving and donor element was 160 g/cm heater line. After printing, the receiving element was separated from the donor element.

The printed image was a 16-step grey scale between data level 0 and 255 (8 bit). The data levels of the different steps were choosen equidistant with respect to the input data level in order to obtain the native sensitometry.

Overall heat treatment

All receiving elements were subsequent to the image-wise heating overall heated on a hot plate of 118° C. for 10 seconds.

Measurement of the optical density of the prints

The optical maximal densities of the overall heated prints were measured after a visual filter in a Macbeth TR924 densitometer in the grey scale part corresponding to data level 255.

Evaluation of the grey tone.

The evaluation of the grey tone of the printed images after heat treatment was determined by visual inspection of the print on a negatoscope (light box).

The following criteria were used:

Bad: the print has a clear yellow-brown shade

Moderate: the print has a moderate yellowish shade

Good: the print has only a faint yellowish shade

Excellent: the print has an excellent grey tone without a specific coloured shade.

The results are listed in table 2.

It is clear from table 2 that the prints made with donor elements according to the present invention have good optical densities and a good to excellent grey tone (neutral hue).

What is claimed is:

1. A thermal imaging process for producing a high gradation image comprising the steps of;

a) bringing a donor layer of a donor element into face to face relationship with a receiving layer of a receiving element to form an assemblage, b) image-wise heating the assemblage, thereby causing image-wise transfer of an amount of a thermotransferable reducing agent and a thermotransferable dye to said receiving element, the amount of said thermotransferred reducing agent being proportional to the amount of heat supplied, c) separating said donor element from said receiving element, and d) overall heating said receiving element, wherein (i) said donor element comprises on a support, (a) a donor layer comprising a binder and a thermotransferable reducing agent which is capable of reducing a silver source to metallic silver upon heating and a thermotransferable dye, and (b) a heat resistant layer provided on the side of the support opposite to the side having said donor layer, and (ii) said receiving element comprises said receiving layer on a support, said receiving layer comprising a silver source which is capable of being reduced by heat in the presence of a reducing agent.

2. A thermal imaging process according to claim 1, wherein said overall heating is performed by means of a heated roller.

3. A thermal imaging process according to claim 1 wherein said receiving element further comprises a toning agent.

4. A thermal imaging process according to claim 1 wherein said image-wise heating is carried out by means of a thermal head.

TABLE 2

| | Reducing agents | | | | | | Dyes | | | | Visual | Grey |
|---|---|---|---|---|---|---|---|---|---|---|---|---|
| Example | A | % | B | % | C | % | A | % | B | % | density | tone |
| 1(Comp) | R1 | 15 | — | | — | | — | | — | | 2.24 | B |
| 2(Comp) | R1 | 10 | R2 | 3 | R3 | 2 | — | | — | | 2.50 | M |
| 3 | R1 | 13 | — | | — | | D11 | 2 | — | | 2.14 | E |
| 4 | R1 | 5 | R2 | 5 | R3 | 2 | D3 | 3 | — | | 2.75 | G |
| 5 | R3 | 13 | — | | — | | D3 | 2 | — | | 2.42 | E |
| 6 | R3 | 7 | R1 | 4.5 | — | | D3 | 3.5 | — | | 2.58 | E |
| 7 | R3 | 8 | R1 | 5 | — | | D3 | 2 | — | | | E |
| 8 | R1 | 10 | — | | — | | D3 | 3 | D12 | 2 | 1.54* | G |

*printed with a thermal head operated at 3.1 Watt/mm$^2$.

Reducing agents:

R1 propylgallate

R2 dihydroxybenzoic acid ethyl ester

R3 4-phenylpyrocatechol

Dyes: for the structure of the dyes, see table 1.

* * * * *

UNITED STATES PATENT AND TRADEMARK OFFICE

CERTIFICATE OF CORRECTION

PATENT NO. : 5,587,268

DATED : December 24, 1996

INVENTOR(S) : Defieuw et al.

It is certified that error appears in the above-indentified patent and that said Letters Patent is hereby corrected as shown below:

Title page, 1st Column, lines 7-8, "Pat. No. 5,547,809" should read --Pat. Nos. 5,589,317; 5,595,854; 5,587,269; 5,587,270; 5,601,962; 5,547,809; 5,558,972 and the patent issuing from Application Ser. No. 08/618,399 filed March 19, 1996--;

Title page, 2nd Column, following 6th line, insert: --246832 9/1962 Australia--;

Column 2, line 26, "This printing ..." should start a new paragraph;

Column 9, line 47, "Mobs" should read --Mohs--;

Column 15, line 48, "50.24" should read --2.24--;

Column 15, line 54, "$\overline{55}$" should read -- — --;

Column 16, line 7, "comprising" should read --comprising, in order,--.

Signed and Sealed this

First Day of July, 1997

Bruce Lehman

*Attest:*

BRUCE LEHMAN

*Attesting Officer*

*Commissioner of Patents and Trademarks*